US005480148A

United States Patent [19]

Bartosik

[11] Patent Number: 5,480,148

[45] Date of Patent: Jan. 2, 1996

[54] WATER DRIVEN ROLLER COASTER GAME

[76] Inventor: Dennis Bartosik, 5705 Jason Lee Pl., Sarasota, Fla. 34233

[21] Appl. No.: 339,836

[22] Filed: Nov. 15, 1994

Related U.S. Application Data

[63] Continuation-in-part of Ser. No. 15,126, Nov. 9, 1993.

[51] Int. Cl.[6] ..... A63F 9/14

[52] U.S. Cl. ..... 273/86 B; 273/86 F; 273/349; 273/387

[58] Field of Search ..... 273/86 R, 86 F, 273/86 G, 86 B, 349, 387

[56] References Cited

U.S. PATENT DOCUMENTS

| | | | |
|---|---|---|---|
| 836,681 | 11/1906 | Gilman | 273/86 F |
| 1,392,764 | 10/1921 | Higuchi | 273/86 G |
| 1,441,404 | 1/1923 | Czerny . | |
| 1,499,875 | 7/1924 | Rosenheim . | |
| 1,533,795 | 4/1925 | Foans . | |
| 1,749,689 | 3/1930 | Baum | 273/387 |
| 2,034,324 | 3/1936 | Brady | 273/86 |
| 2,732,210 | 1/1956 | Heide | 273/86 |
| 3,336,030 | 8/1967 | Martell et al. | 273/349 |
| 3,411,783 | 11/1968 | Montagna | 276/86 |
| 3,572,712 | 3/1971 | Vick | 273/86 F |
| 3,645,529 | 2/1972 | Andrews | 273/103 |
| 3,781,011 | 12/1973 | Barlow | 273/86 |
| 5,118,320 | 6/1992 | Miller | 446/228 |

*Primary Examiner*—William H. Grieb
*Attorney, Agent, or Firm*—Franklin J. Cona

[57] ABSTRACT

A water activated roller coaster game system for fun and amusement and prizes is disclosed. The system comprises a game housing having an enclosed rear face and an enclosed side face and an enclosed top roof and an enclosed bottom floor and an open front face for the people to participate and observe the progress of the game. A plurality of roller coasters and race tracks are disposed within the game housing in a parallel orientation, each roller coaster being dedicated to traverse one of the race tracks from a start line to a finish line. A plurality of game consoles are disposed adjacent to the game housing and control one of the roller coasters. A plurality of motor means are disposed in the game housing. Each motor means is electrically coupled to one roller coaster for moving the roller coaster. Each console has a switch means disposed therein and further being in an electric circuit therebetween one of the consoles and one of the roller coasters for moving the roller coaster when in a closed status and halting the roller coaster when in an open status. A second plurality of switch means are disposed in the game housing at the finish line of one of the race tracks and further being in an electric circuit therebetween the finish line of one race track and a pop-up winner indicator disposed rearwardly on one of the game consoles.

15 Claims, 10 Drawing Sheets

WATER DRIVEN ROLLER COASTER GAME

This application is a Continuation-In-Part application of application Ser. No. 9/015,126, filed Nov. 9, 1993 now pending.

BACKGROUND OF THE INVENTION

1. Field of the Invention

The present invention relates to water driven amusement games, and in particular to a competitive arcade game using a plurality of roller coasters on a tracked layout having straight sections and arcuate sections.

2. Description of the Background Art

Throughout the United States steps are being taken to improve competitive arcade amusement games having a reasonable level of difficulty for people having moderate dexterity and skill for retaining the interest of the participants during the game.

U.S. Pat. No. 1,441,404 issued to Czerny discloses a roller coaster game having a target to initiate movement of a vehicle on the roller coaster.

U.S. Pat. No. 2,034,324 issued to Brady discloses a game having a projectile means, target means to receive the projectile means, and figures which move in response to the projectile impacting on the target means.

U.S. Pat. No. 3,781,011 issued to Barlow discloses a game having a projectile means, target means to receive the projectile means, and figures which move in response to the projectile impacting on the target means.

U.S. Pat. No. 2,732,210 issued to Heide discloses an amusement racing game wherein projectile balls roll down one of several chutes having electrical tripping circuits within each chute to propel a figure, usually a horse, along a track.

U.S. Pat. No. 1,533,795 issued to Foans discloses an arcade racing game wherein a projectile element physically impacts and moves the impacted figure along the raceway.

U.S. Pat. No. 1,499,875 issued to Rosenheim discloses an arcade racing game wherein a projectile element physically impacts and moves the impacted figure along the raceway.

U.S. Pat. No. 3,411,783 issued to Montagna discloses a roller coaster game.

U.S. Pat. No. 5,118,320 issued to Miller also discloses a roller coaster game.

U.S. Pat. No. 3,645,529 issued to Andrews discloses a target game having an electronic basis for moving electronic images on a screen over a game board.

None of these previous efforts, however, provide the benefits intended with the present invention. Additionally, prior techniques do not suggest, the present inventive combination of component elements as disclosed and claimed herein. The present invention achieves its intended purposes, objectives and advantages over the prior art devices through a new, useful and unobvious combination of component elements, which is simple to use, with the utilization of a minimum number of functioning parts, at a reasonable cost to manufacture, assemble, test and by employing only readily available material.

Therefore, it is an object of the present invention to provide a new and improved water driven roller coaster game that can be enjoyed by participants of all ages.

It is a still further object of the invention to provide a water driven roller coaster game that rewards accuracy with a prize for propelling the roller coasters along the race track.

It is a still further object of the invention to indicate the winner of each race by having a pop-up winner graphic symbol arise behind the console where the contestants sit to use and operate the game.

It is a still further object of the invention to provide a track system that will be rust and corrosion resistant for long life of the system as it is moved from place to place.

It is yet another object of the invention to provide a console with the actuator element under control of the contestant and a visual target in the rearward portion of the console that is adapted to be struck by the actuator element, and in particular a water driven actuator element.

It is yet another object of the invention to provide a visual graphic element that indicates to the contestant his relative success vis-a-vis the other contestants in moving their respective visual graphic element towards the finish line before the other contestants.

It is yet another object of the invention to provide a system that can be transported easily from place to place on a standard trailer frame.

It is one more object of the invention to provide a system that can be permanently installed in a facility such as a casino or the like.

A final object of this invention to be specifically enumerated herein is to provide a water driven roller coaster game in accordance with the proceeding objects and which will conform to conventional forms of manufacture, be of simple construction and easy to use so as to provide a device that would be economically feasible, long lasting and relatively trouble free in operation.

Although there have been many inventions related to water driven roller coaster games none of the inventions have become sufficiently compact, low cost and reliable enough to become commonly used. The present invention meets the requirements of the simplified design, compact size, low initial cost, low operating cost, ease of installation and maintainability, and minimal amount of training to successfully employ the invention.

The foregoing has outlined some of the more pertinent objects of the invention. These objects should be construed to be merely illustrative of some of the more prominent features and applications of the intended invention. Many other beneficial results can be obtained by applying the disclosed invention in a different manner or modifying the invention within the scope of the disclosure. Accordingly, other objects and a fuller understanding of the invention may be had by referring to the summary of the invention and the detailed description of the preferred embodiments in addition to the scope of the invention defined by the claims taken in conjunction with the accompanying drawings.

SUMMARY OF THE INVENTION

The invention is defined by the appended claims with the specific embodiment shown in the attached drawings. For the purpose of summarizing the invention, the invention may be incorporated into a water activated roller coaster game system for use by people for fun and amusement and prizes. The system comprises a game housing having an enclosed rear face and enclosed side faces and an enclosed top roof and an enclosed bottom floor and an open front face for the people to participate in the game and observe the progress of the game. A plurality of roller coasters and a plurality of race tracks are disposed within the game housing in a parallel orientation. Each roller coaster is dedicated to traverse one of the race tracks from a start line to a finish line. The roller coasters are controlled by a plurality of game consoles that are disposed adjacent to the game housing and outside the front face. Each game console activates and controls the traverse of one of the roller coasters over one of the race tracks.

A plurality of motor means are disposed in the game housing and adjacent to the race tracks. Each motor means is electrically coupled to one roller coaster and moves the roller coaster over one of the race tracks. A plurality of switch means are interconnected in an electric circuit therebetween one of the consoles and one of the roller coasters and move the roller coaster over the race track when in a closed status and halt the roller coaster when in an open status.

A second plurality of switch means are interconnected in an electric circuit therebetween the finish line of one race track and a pop-up winner indicator disposed rearwardly on one of the game consoles. The second switch means raises the pop-up winner indicator when a winning roller coaster reaches the finish line.

The foregoing has outlined rather broadly the more pertinent and important features of the present invention in order that the detailed description of the invention that follows may be better understood so that the present contribution to the art can be more fully appreciated. Additional features of the invention will be described hereinafter which form the subject of the claims of the invention. It should be appreciated by those skilled in the art that the conception and the specific embodiments disclosed may be readily utilized as a basis for modifying or designing other structures for carrying out the same purposes of the present invention. It should also be realized by those skilled in the art that such equivalent structures do not depart from the spirit and scope of the invention as set forth in the appended claims.

BRIEF DESCRIPTION OF THE DRAWINGS

For a fuller understanding of the nature and objects of the invention, reference should be had to the following detailed description taken in connection with the accompanying drawings in which:

FIG. 1 also shows the arcuate 360° loops in a non-synchronous pattern and discloses the actuator elements having a common barricade and a common box having a plurality of target elements;

FIG. 2 also discloses a plurality of individual consoles for activating and controlling the roller coasters on the race tracks. FIG. 2 also discloses the 360° arcuate loops forming a transverse tunnel relationship therebetween a plurality of straight track sections;

FIG. 3 discloses the race track in a right-side-up orientation for traversing the interior portion of the 360° arcuate loop;

FIG. 4 also discloses the individual console embodiment of the invention;

Similar reference characters refer to similar parts throughout the several views of the drawings.

DETAILED DESCRIPTION OF THE PREFERRED EMBODIMENT

Figure 1:
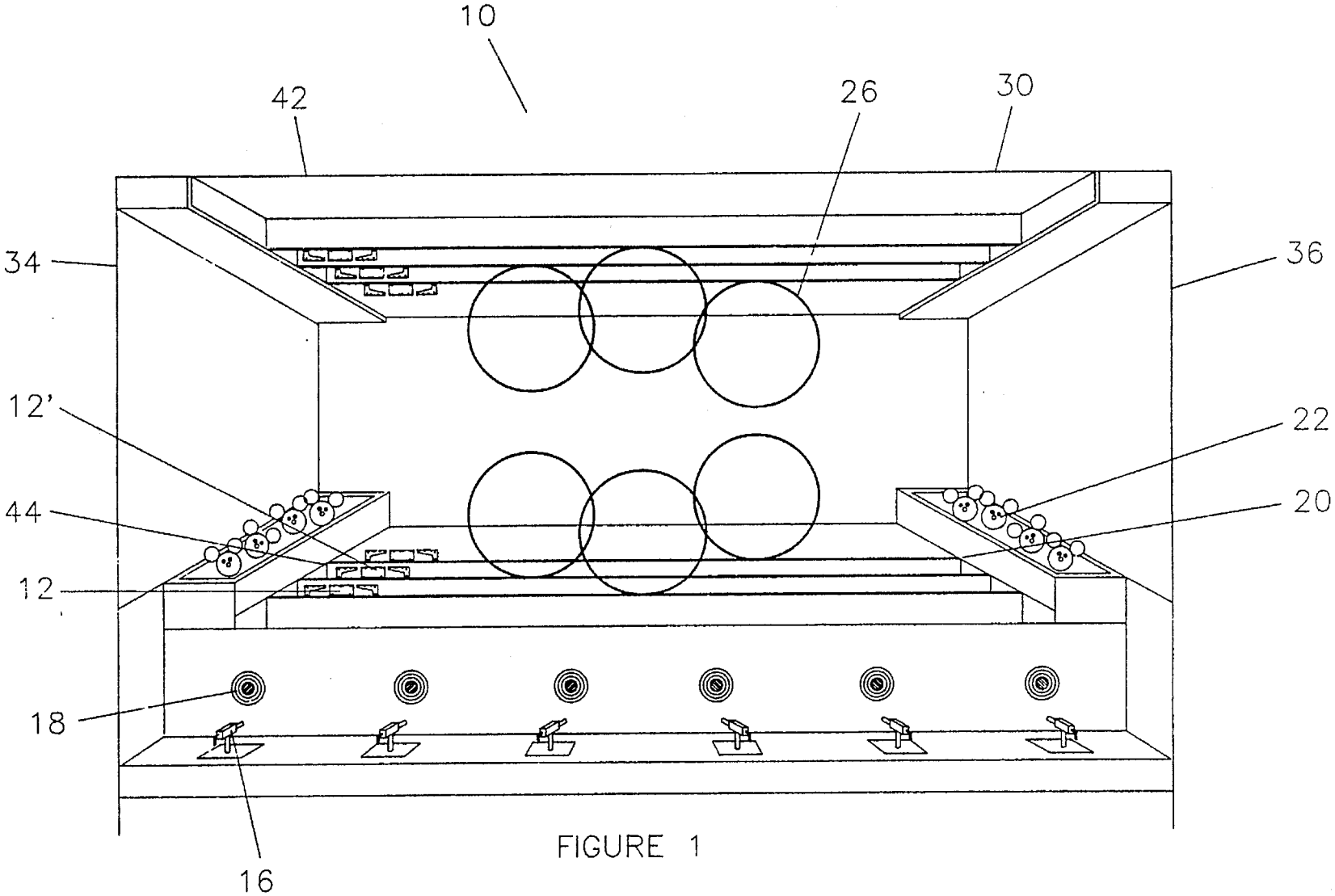
FIG. 1 is a perspective view of the invention showing the plurality of tracks being disposed in an overhead orientation as well as a right-side-up orientation.
Figure 2:
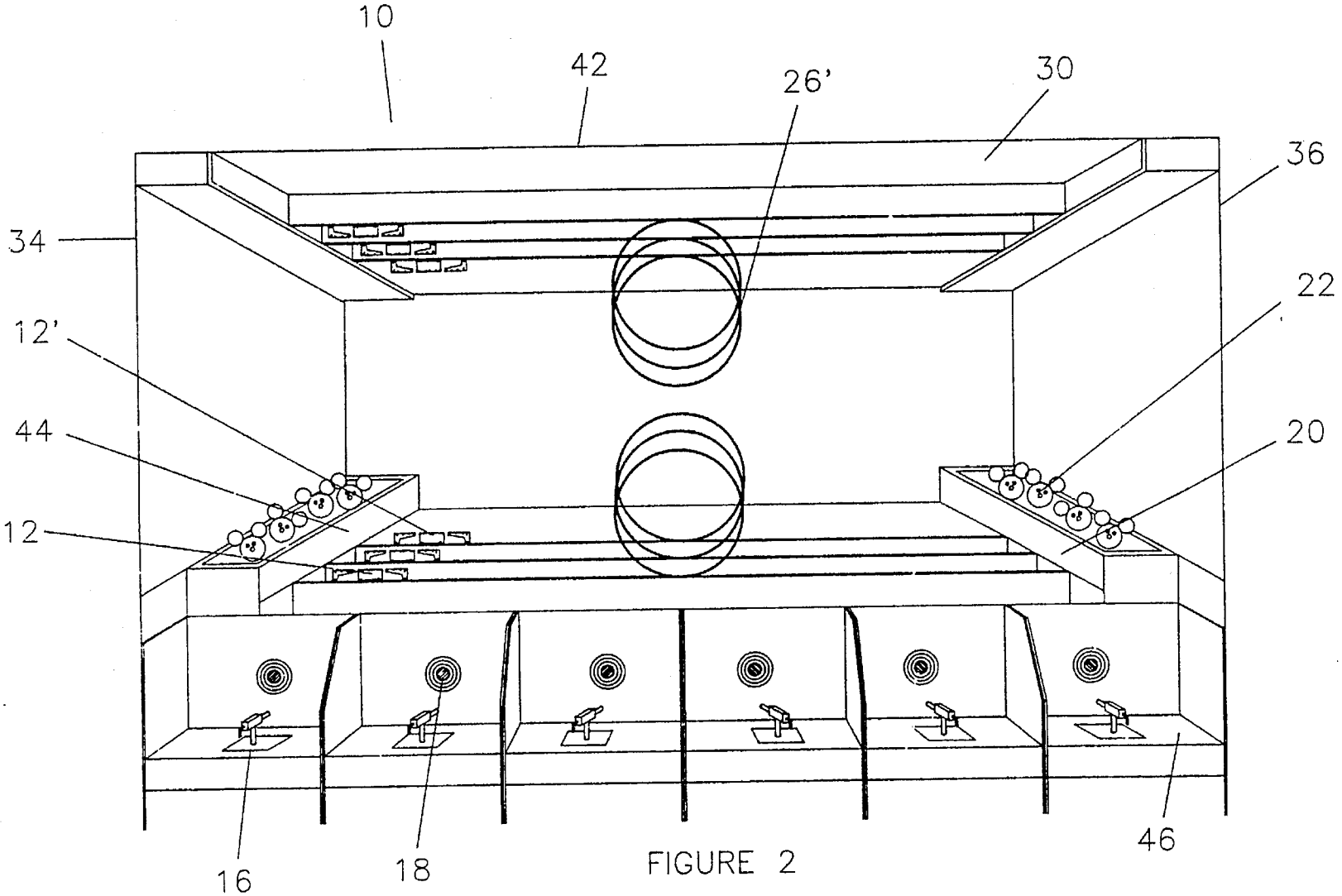
FIG. 2 is a perspective view of another embodiment of the invention disclosing a plurality of race tracks disposed in an up-side-down orientation as well as a right-side-up orientation.

Basically, the invention 10 comprises a plurality of movable visual graphic elements, as best seen in FIGS. 1 and 2, namely a plurality of miniature roller coasters 12, 12' that are involved in a competitive game between contestants. The invention 10 is intended for the amusement of the participants at county fairs and other community fund raising activities.

Figure 3:
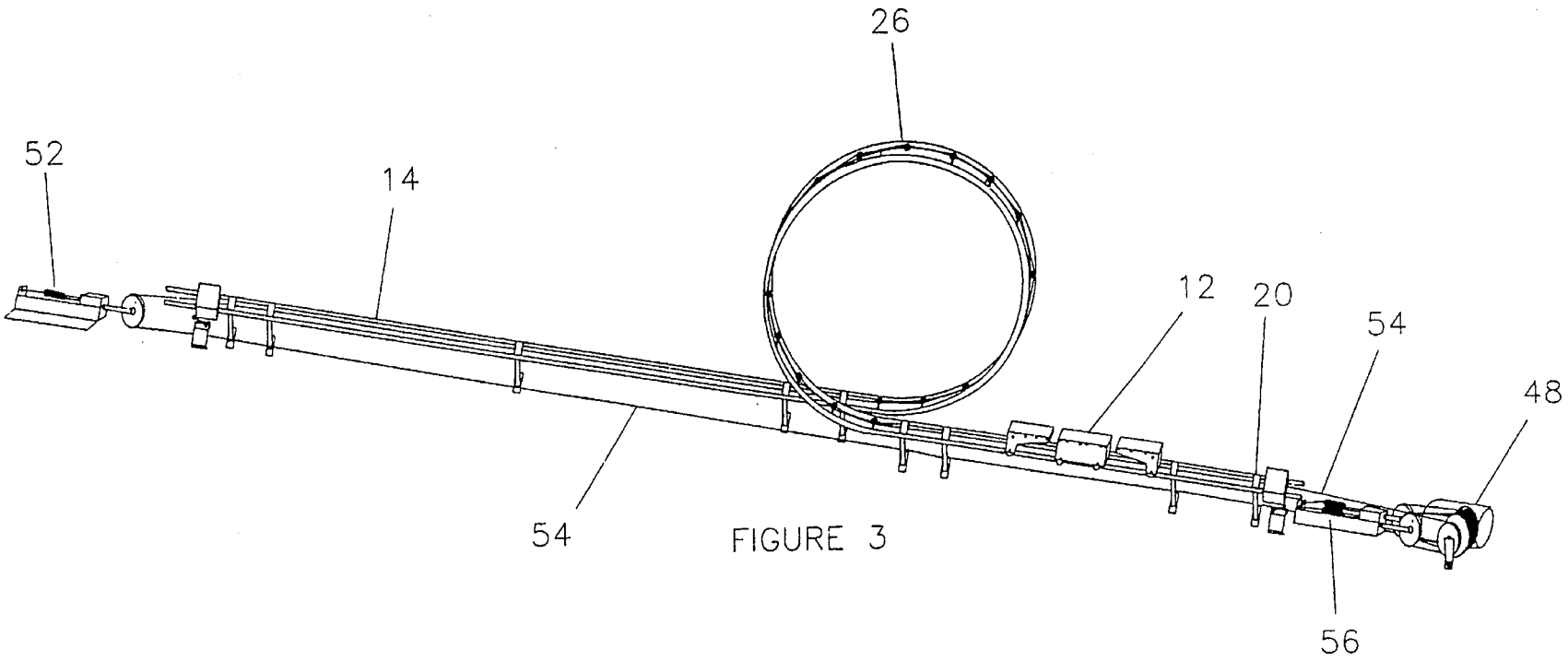
FIG. 3 is a perspective view of an individual roller coaster and race track and motor and guide cable.

The invention 10 comprises three primary components. The first primary component is the visual graphic element 12, 12' which in the preferred embodiment is the individual roller coaster. Each roller coaster 12 is mounted on a separate track 14, as best seen in FIG. 3, and is colored to differentiate between the plurality of visual graphic elements.

The second primary component is the actuator element. In the preferred embodiment, the actuator element is a pressurized water gun 16 for the contestant to aim and operate. The third primary component is a target element 18. When the contestant strikes the target element 18, the visual graphic element 12 is moved forward on the track 14. By striking the target element 18 with intermittent pulses of water, the visual graphic element 12 (the roller coaster) will move rapidly towards a finish line 20, 20'. Of course, the first contestant to move his or her roller coaster 12 to the finish line 20, wins the contest and an appropriate prize 22. Other forms of actuators are also possible. For example, a ball throwing apparatus (non-illustrated) can be utilized as a substitute for the water gun 116 apparatus. That is, by throwing balls at a target 18 rapidly and successfully, the visual graphic element 12 will be moved towards the finish line 20 and results in a victory for the person with the most accurate throwing arm.

Figure 4:
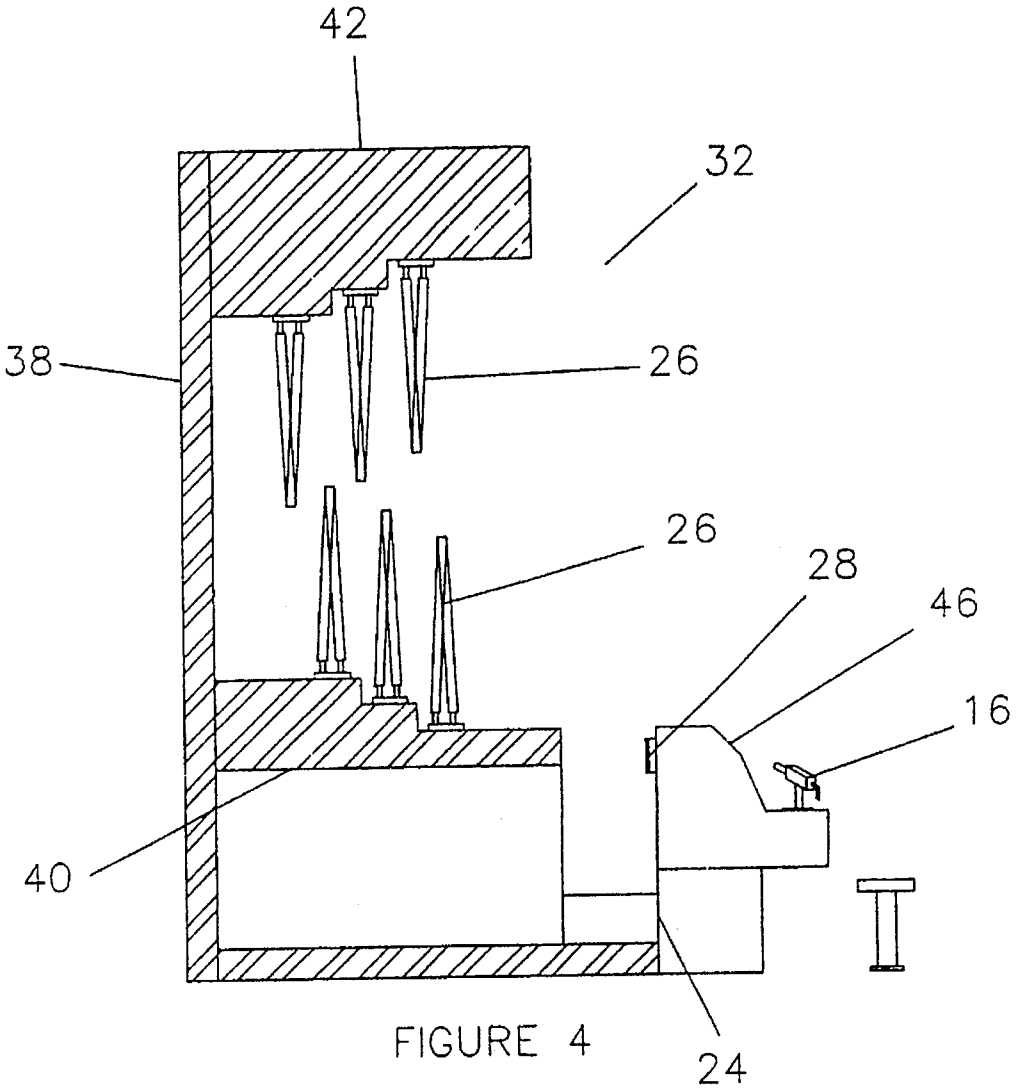
FIG. 4 is a transverse cross-section of the invention showing the relationship of the top face and bottom housing to the plurality of race tracks.
Figure 29:
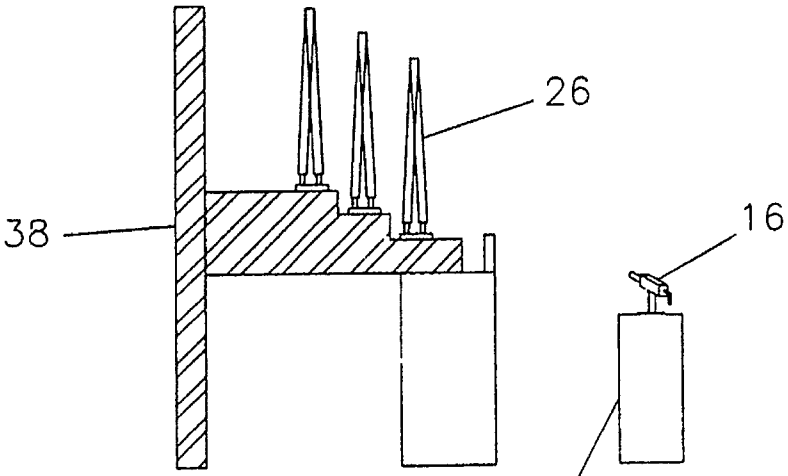
FIG. 29 is a transverse cross-section of another embodiment of the invention showing the plurality of race tracks in a right-side-up orientation.
Figure 27:
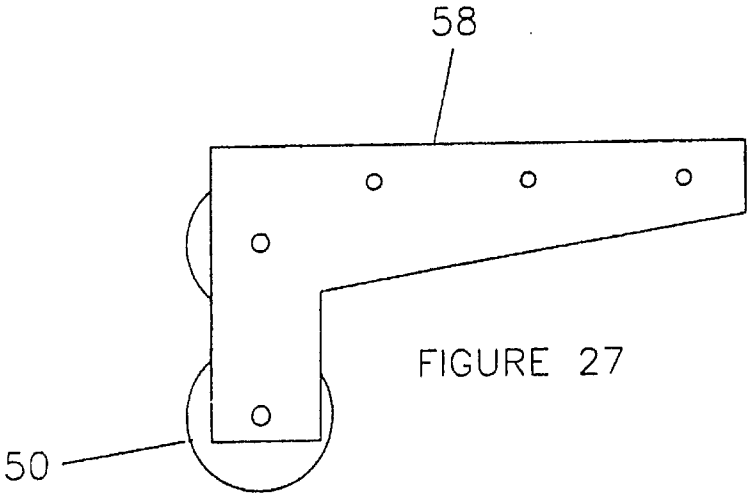
FIG. 27 is a rear elevation view of a trailing roller coaster car.

The contestants are separated from the visual graphic element 12 and the target element 18 by a barricade 24 as best seen in FIGS. 4 and 29. The water gun 16 is mounted on the barricade 24. The contestants lean on the barricade 24 to assist them in steadying their aim when using the water gun 16. The distance between the barricade 24 and the target element 18 can be increased to increase the degree of difficulty. For example, if the audience is comprised of preteen youngsters, the barricade 24 can be moved closer to the target element 18. Alternatively, if the audience of contestants is teenagers or young adults, the barricade 24 can be moved further from the target element 18 to increase the degree of difficulty.

At the appropriate start signal, the contestants fire rapidly and repeatedly at the target element 18. The person scoring the most frequent hits on the target element 18 will move the roller coaster 12 along the track 14 and through an arcuate loop 26 towards the finish line 20 first, and accordingly, win the prize 22. When the roller coaster 12 arrives at the finish line 20, an appropriate graphic symbol 28 pops up to indicate the number of the person and the track winning the particular contest and the end of the race.

In addition to the above two described actuator elements, a laser actuated aiming device (non-illustrated) that emits energy can also be used, but that is less preferred than the water gun 16 or the ball derby actuation.

The visual graphic elements 12, 12' and the tracks 14, 14' are recessed within a game housing 30. The game housing 30 has an open front face 32 with enclosed sides 34, 36 and enclosed rear face 38 and a floor 40 and an enclosed rooftop 42, as best seen in FIG. 4, to house the plurality of visual graphic elements 12. The visual graphic elements 12, 12' and the race tracks 14, 14' are disposed within the game housing 30 in a parallel orientation. Each roller coaster 12 is restricted to traversing one race track 14 from a start line 44 to the finish line 20.

The water gun 16 is mounted in a game console 46 which is disposed adjacent to the game housing 30 outside of the front face 32.

Figure 5:
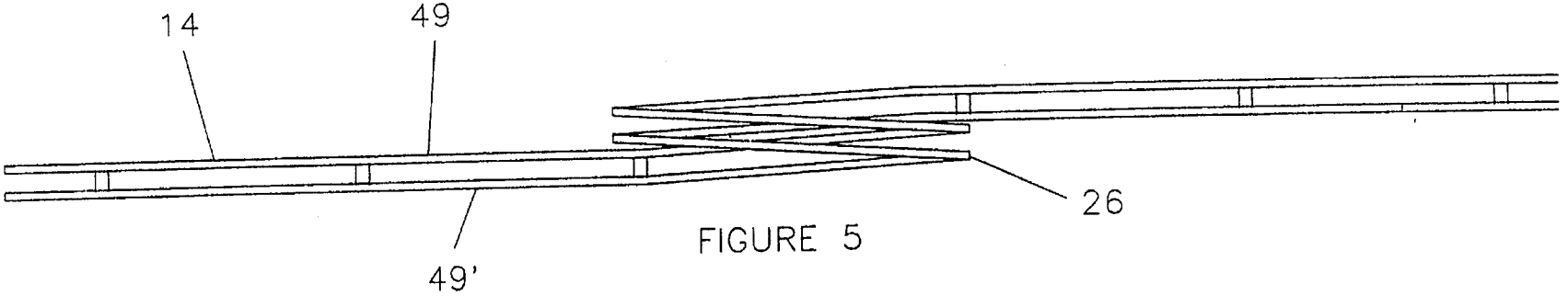
FIG. 5 is a top plan view of an individual race track section disclosing a leftmost straight section, a rightmost straight section, and an arcuate section therebetween.
Figure 6:
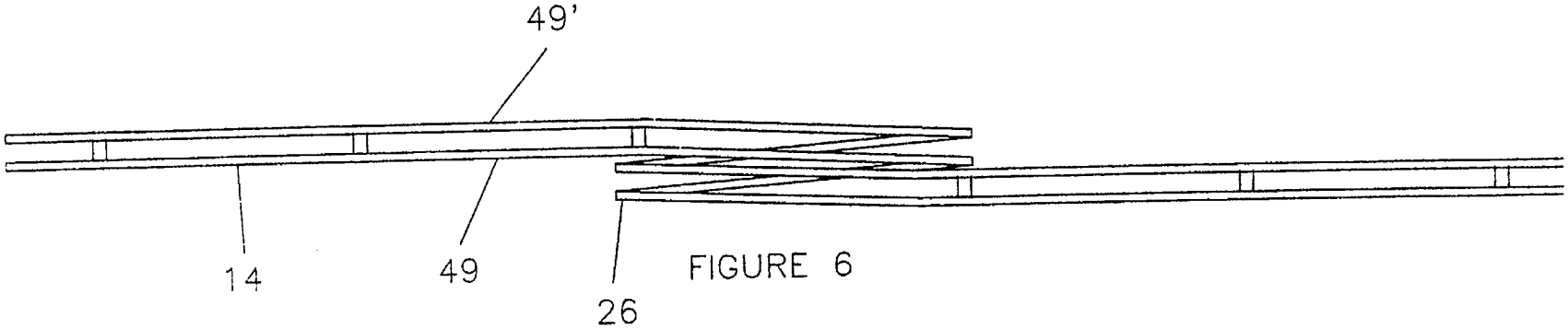
FIG. 6 is a bottom plan view of the single section of the race track as disclosed in FIG. 3.
Figure 7:
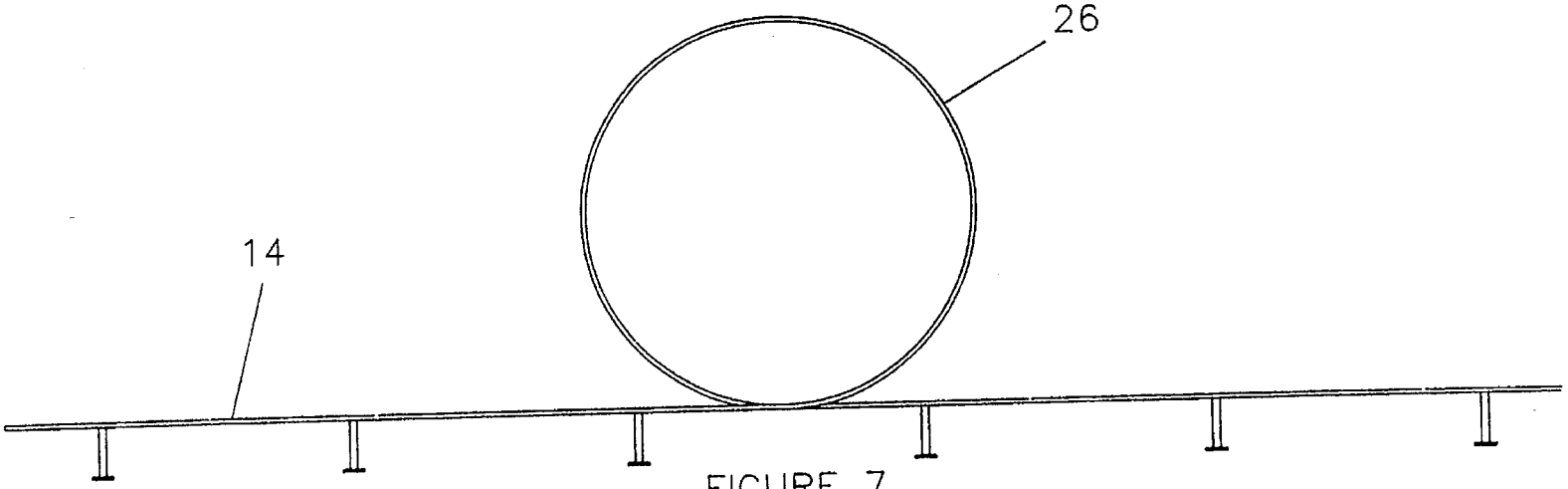
FIG. 7 is a front elevation view of a single section race track as disclosed in FIG. 3.
Figure 9:
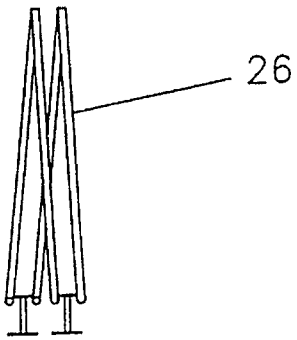
FIG. 9 is a right hand elevation view of a typical portion of a 360° arcuate loop race track section.
Figure 8:
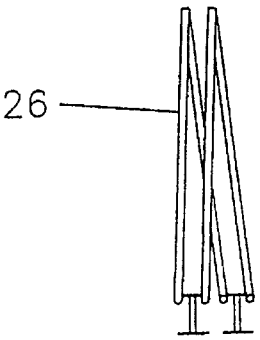
FIG. 8 is a left hand end view of a typical arcuate section of a race track.
Figure 11:
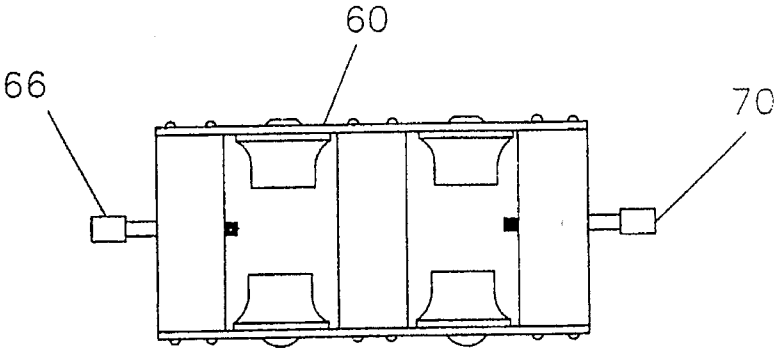
FIG. 11 is a bottom plan view of a middle roller coaster car.
Figure 14:
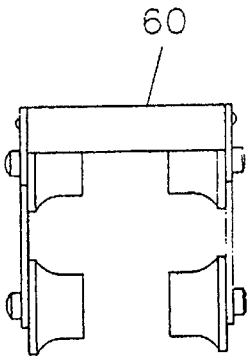
FIG. 14 is a left hand elevation view of a middle roller coaster car.
Figure 13:
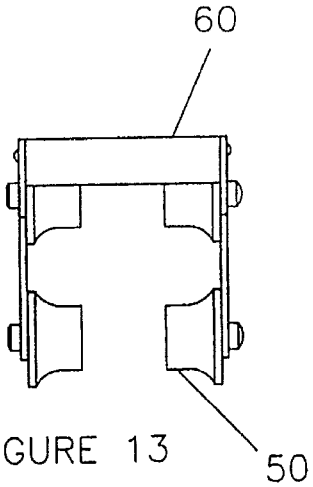
FIG. 13 is a right hand elevation view of a middle roller coaster car.
Figure 10:
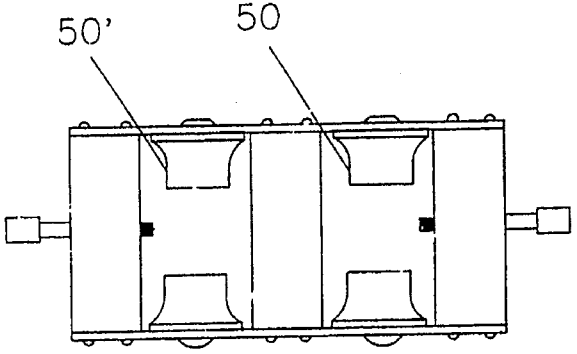
FIG. 10 is a top plan view of the middle roller coaster car.
Figure 12:
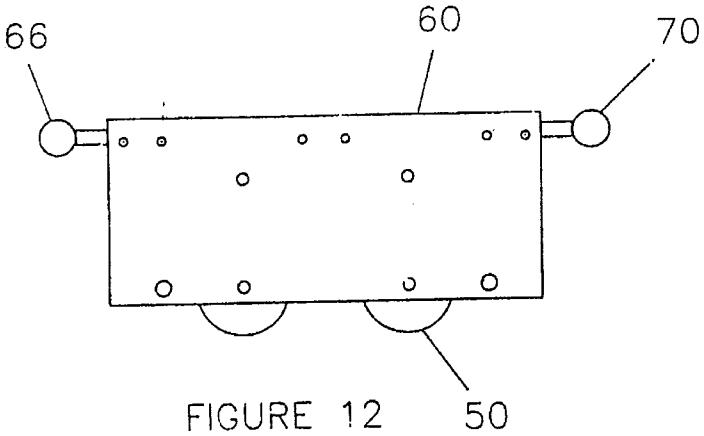
FIG. 12 is a front elevation view of a middle roller coaster car.
Figure 17:
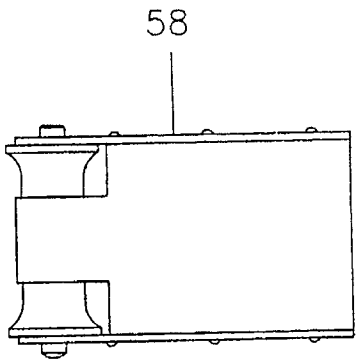
FIG. 17 is a bottom plan view of a leading roller coaster car.
Figure 20:
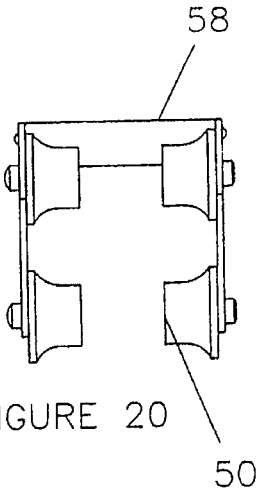
FIG. 20 is a left hand end view of a leading roller coaster car.
Figure 16:
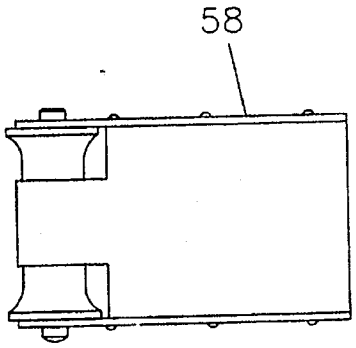
FIG. 16 is a top plan view of a leading roller coaster car.
Figure 19:
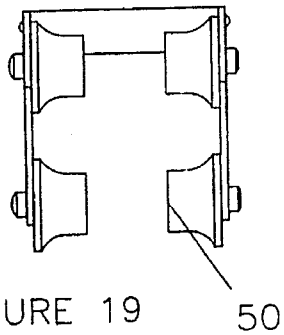
FIG. 19 is a right hand end view of a leading roller coaster car.
Figure 15:
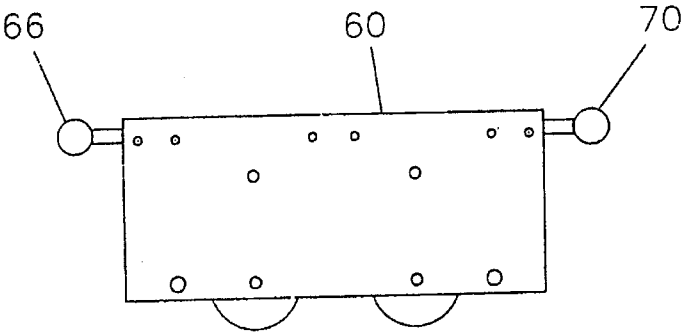
FIG. 15 is a rear elevation view of a middle roller coaster car.
Figure 18:
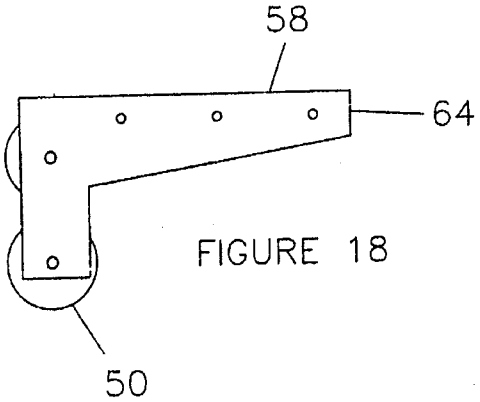
FIG. 18 is a front elevation view of a leading roller coaster car.
Figure 23:
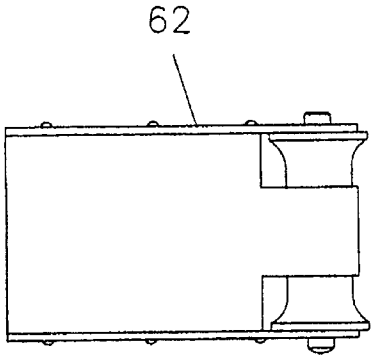
FIG. 23 is a bottom plan view of a trailing roller coaster car.
Figure 26:
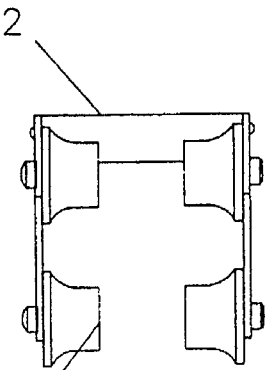
FIG. 26 is a right hand end view of a trailing roller coaster car.
Figure 22:
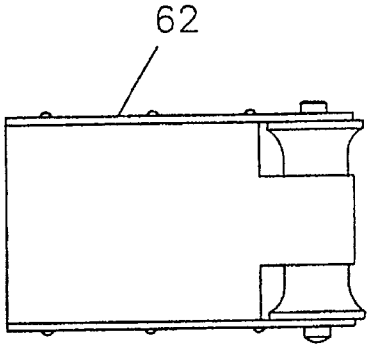
FIG. 22 is a top plan view of a trailing roller coaster car.
Figure 25:
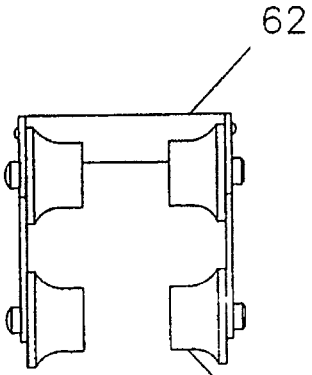
FIG. 25 is a left hand end view of a trailing roller coaster car.
Figure 21:
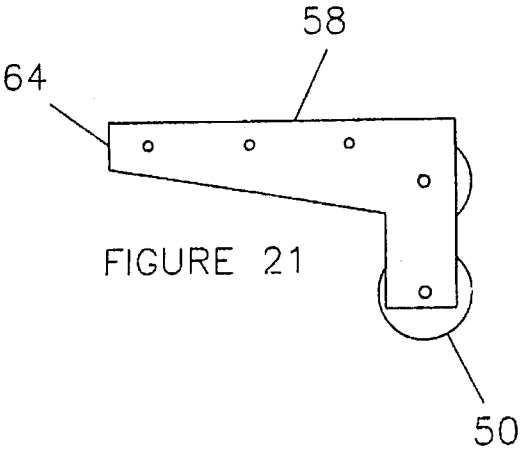
FIG. 21 is a rear elevation view of a leading roller coaster car.
Figure 24:
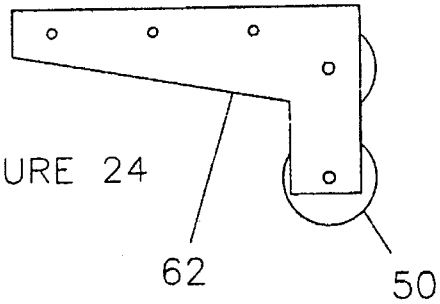
FIG. 24 is a front plan view of a trailing roller coaster car.
Figure 28:
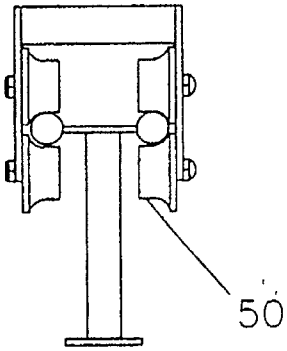
FIG. 28 is an end view of a typical roller coaster car in rolling engagement with the plurality of tracks.

As best seen in FIG. 2, the preferred embodiment has the water gun 16 and the target element 18 housed within the game console 46. Each game console 46 activates and controls one of the roller coasters 12 over one of the race tracks 14. A plurality of motor means 48 are disposed in the game housing 30 and adjacent to the race tracks 14. Each motor means 48 is electrically coupled to a roller coaster 12 and moves the roller coaster 12 over one of the race tracks 14. As best seen in FIGS. 5 and 6, each race track 14 is comprised of paired tubular members 49, 49'. The roller coaster 12 has a plurality of arcuate wheels 50 which urge smooth, low friction traverse of the race track 14 over the paired tabular members 49, 49' towards the finish line 20.

A plurality of switch means 52 are disposed in each game console 46 therebetween the console 46 and one of the roller coasters 12. The switch means 52 close the electrical circuits between the motor means 48 and a continuous looped cable 54 for moving the roller coaster 12 over the race track 14 when in a closed circuit status and halting the traverse of the roller coaster 12 when in an open circuit status.

A second plurality of switch means 56 are disposed in the game housing 30 at the finish line 20 of each race track 14. The second plurality of switch means is disposed therebetween the finish line 20 of each race track 14 and a pop-up winner indicator 28 that is disposed rearwardly on each one of the game consoles 46. The second switch means 56 is disposed electrically to raise the pop-up winner indicator 28 when a winning roller coaster 12 reaches the finish line 20.

As best see in FIGS. 10–28, the visual graphic element 12 comprise a trio of individual cars 58, 60, 62. Specifically a leading car 58, a trailing car 62, and a middle car 60 therebetween. The leading car 58 has an end 64 adapted for removable coupling to a leading end 66 of the middle car 60, and the trailing car 62 has an end 68 adapted for removable coupling to a second end 70 of the middle car 60. In this manner, the configuration of the roller coaster 12 can be altered to vary the visual graphic element of the individual invention 10.

The balance of the amusement game comprises overhead lighting and artistic interpretations on a back panel that are not novel.

Now that the invention has been described,

What is claimed is:

1. A water activated roller coaster game system for use by people for fun and amusement and prizes comprising in combination:

a game housing having an enclosed rear face and an enclosed side face and an enclosed top roof and an enclosed bottom floor and an open front face for the people to participate in the game and observe the progress of the game;

a plurality of roller coasters and a plurality of race tracks disposed within the game housing in a parallel orientation, each roller coaster being dedicated to traverse one of the race tracks from a start line to a finish line;

a plurality of game consoles disposed adjacent to the game housing and outside the front face, each game console for activating and controlling the traverse of one of the roller coasters over one of the race tracks;

a plurality of motor means disposed in the game housing and adjacent to the race tracks, each motor means being electrically coupled to one roller coaster for moving the roller coaster over one of the race tracks;

a plurality of switch means, each switch means being disposed in one of the game consoles and further being therebetween one of the consoles and one of the roller coasters for moving the roller coaster over the race track when in a closed status and halting the roller coaster when in an open status;

a second plurality of switch means, each second switch means being disposed in the game housing at the finish line of one of the race tracks and further being therebetween the finish line of one race track and a pop-up winner indicator disposed rearwardly on one of the game consoles, the second switch means for raising the pop-up winner indicator when a winning roller coaster reaches the finish line.

2. A water activated roller coaster game system for use by people for fun and amusement and prizes as recited in claim 1 wherein each race track further includes a pair of elongated tubular members in a parallel relationship, each race track having a plurality of horizontally disposed sections and an arcuate section forming a closed loop 360° traverse therebetween the horizontally disposed sections.

3. A water activated roller coaster game system for use by people for fun and amusement and prizes as recited in claim 2 and further including a plurality of arcuate sections.

4. A water activated roller coaster game system for use by people for fun and amusement and prizes as recited in claim 3 wherein the plurality of arcuate 360° loops are oriented between the start line and the finish line, each loop being connected to the other loop by a section of horizontally disposed race track.

5. A water activated roller coaster game system for use by people for fun and amusement and prizes as recited in claim 2; wherein each roller coaster is disposed above the race track and traverses the 360° arcuate loop inside the loop.

6. A water activated roller coaster water game system for use by people for fun and amusement and prizes as recited in claim 2 wherein each roller coaster is coupled to the race track and disposed below the race track for traversing the arcuate 360° loop outside the plane defined by the loop.

7. A water activated roller coaster game system for use by people for fun and amusement and prizes as recited in claim 1 wherein each race track further includes a cable oriented in a second plane defined by the elongated tubular members, the cable being coupled to the roller coaster for guiding the roller coaster along the race track and keeping the roller coaster in rolling communication with the race track irrespective of the orientation of the roller coaster to the race track and the 360° arcuate loop.

8. A water activated roller coaster game system for use by people for fun and amusement and prizes as recited in claim 7 wherein each roller coaster further include a plurality of wheels disposed under the roller coaster and being adapted for urging rolling communication with the race track.

9. A water activated roller coaster game system for use by people for fun and amusement and prizes as recited in claim 7 wherein each race track further includes a plurality of pulleys attached to the tubular member, and being in rotational communication with the cable for urging smooth movement of the roller coaster along the race track towards the finish line.

10. A water activated roller coaster game system for use by people for fun and amusement and prizes as recited in claim 2 wherein the 360° arcuate loops form a transverse tunnel along the horizontally disposed race tracks.

11. A water activated roller coaster game system for use by people for fun and amusement and prizes as recited in claim 2 wherein the 360° arcuate loops are oriented along the length of the horizontally disposed race tracks in a non-coplaner pattern for not forming any transverse tunnel relationship.

12. A water activated roller coaster game system for use by people for fun and amusement and prizes as recited in claim 1 wherein each console further includes an aiming device and a target, the aiming device for directing a stream of fluid at the target for urging the roller coaster to traverse the race track towards the finish line.

13. A water activated roller coaster game system for use by people for fun and amusement and prizes as recited in claim 12 wherein each target is adapted with a recess having a base for receiving the stream, the base being adapted to move rearwardly when the stream hits the base, the base further being in electrical circuit communication with one of the motor means and a microswitch that closes when the base moves a desired distance rearwardly, the base still further having a spring disposed rearward of the base on an exterior side and being biased to return the base to a resting position that opens the microswitch when the stream does not strike the base.

14. A water activated roller coaster game system for use by people for fun and amusement and prizes as recited in claim 13 wherein each recess further includes graphic indicia on an interior side urging the person to direct the stream at the interior face of the base in order to move the roller coaster along the race track towards the finish line.

15. A water activated roller coaster game system for use by people for fun and amusement and prizes as recited in claim 1 wherein the plurality of race tracks are disposed within the game housing on the bottom floor in an upstanding orientation and also disposed downwardly from the top roof in an up-side-down orientation for doubling the number of players per game.

* * * * *